US005993603A

United States Patent [19]

Johnston

[11] Patent Number: 5,993,603

[45] Date of Patent: Nov. 30, 1999

[54] TRANSPARENTIZED PAPER

[75] Inventor: Robert C. Johnston, Binghamton, N.Y.

[73] Assignee: Association of Capital and Employees, Inc., Quincy, Fla.

[21] Appl. No.: 08/059,887

[22] Filed: May 10, 1993

Related U.S. Application Data

[63] Continuation-in-part of application No. 07/853,950, Mar. 19, 1992, abandoned.

[51] Int. Cl.[6] ..... D21H 19/14

[52] U.S. Cl. ..... 162/135; 162/175; 427/161

[58] Field of Search ..... 427/161; 162/175

[56] References Cited

U.S. PATENT DOCUMENTS 1,996,858 4/1935 Davidson ..... 427/161

3,404,029 10/1968 Dooley et al. ..... 117/155

5,055,354 10/1991 Simcoke ..... 428/342

*Primary Examiner*—Peter Chin

*Attorney, Agent, or Firm*—Lockwood, Alex, Fitz-Gibbon & Cummings

[57] ABSTRACT

Transparentized paper is prepared by impregnating a paper web with a solution of a sucrose acetate isobutyrate in a lower alcohol and removing the residual alcohol. The preferred paper is 100% cotton rag content, the preferred lower alcohol solvent contains up to 5 carbon atoms, particularly isopropanol. In production, the transparentizing solution is applied to one side of a travelling paper web, excess solution is removed by an air knife, wire wound rod or other means, and residual solvent is removed by impinging hot air on the travelling web. The sucrose acetate isobutyrate can also be applied when fluidized by heating and in the absence of a solvent. The preferred content of sucrose acetate isobutyrate residual in the paper web is from about 10% to about 50% of the paper content of the transparentized paper.

8 Claims, No Drawings

TRANSPARENTIZED PAPER

This is a continuation-in-part of my prior application Ser. No. 07/853,950, filed Mar. 19, 1992, now abandoned.

BACKGROUND AND DESCRIPTION OF THE INVENTION

This invention relates to improvements and innovations in transparentized paper and methods of making the same. Transparentized paper, sometimes known as tracing paper of vellum, has long been used as a drafting medium by architects, engineers and draftsmen. More recently, with the advent of computer assisted drafting, it is used in xerographic copiers and in computer driven xerographic laser and pen plotters. For xerographic applications it is essential that the paper be free of traces of solvent used in the transparentizing process. Such solvents cause severe damage to the organic photoreceptors used on the drums in xerographic machines. Among other properties required, a high level of translucency is needed in order to facilitate rapid reproduction of the drawing by those repographic processes using transmitted light.

In current practice, the required level of translucency is achieved by impregnating the paper, usually a 100% cotton fiber sheet, with a resin whose refractive index is close to that of the cotton fibers. Thus the resin partially fills the interstices between the fibers in the sheet, reducing the number of interfacial refractions a light ray must undergo in traversing the paper. The impregnation is usually accomplished by dipping the paper in a solution of an appropriate resin in an organic solvent, rerolling the paper containing the resin and solvent, allowing it to remain in pack for from several hours to several days, then removing the solvent by drying with heat. Heretofore, the resins and resin blends used for transparentizing have involved at least some of the class of hydrocarbon resins requiring hydrocarbon solvents for their solution. These solvents are difficult or impossible to remove completely from the cellulose fibers or the hydrocarbon resin transparentizing agent. Besides creating an unpleasant odor which is objectionable to the user, the residual retained solvent damages the photoreceptor coating on the drum of the xerographic machine when the paper contacts it. In addition, hydrocarbon solvents are hazardous to handle and are detrimental to the environment.

We have found that it is possible to eliminate residual solvent in the transparentized product by the use of a lower alcohol as a solvent and a mixed acetate isobutyrate sucrose ester as the transparentizing agent. The lower alcohols containing up to 5 carbon atoms are readily released by the completely esterified sucrose at temperatures reached during the drying process. The finished vellum has no odor and has no effect on the photoconductive coating on the xerographic drum.

A further advantage of this combination of solvent and transparentizing agent is the very rapid penetration of the sucrose acetate isobutyrate/alcohol solution into the sheet and the rapid attainment of a uniform distribution within the sheet. The need for a "wet pack" conditioning step is eliminated. The web may thus be impregnated and the solvent removed in one pass, eliminating one time consuming step in the usual process. In addition, the viscosity of the transparentizing solution is sufficiently low that the application to the web may be to one side only and the excess removed by air knife, wire wound rod other doctoring device. The alcohol solvent is readily evaporated with relatively low air velocity and temperature.

The sucrose acetate isobutyrate (Eastman Chemical) which has been used is a completely substituted sucrose compound with between 2 and 3 acetate groups and 5 and 6 isobutyrate groups. It is in an amorphous state at all accessible temperatures. Although hard at normal temperatures, the viscosity drops rapidly at elevated temperatures. At 160° C. the viscosity is approximately 20 centipoise. This property is responsible for the rapid attainment of uniform distribution within the sheet even after the alcohol has been completely evaporated. In fact, we have found that paper can be transparentized without the use of any solvent by applying the fluidized sucrose acetate isobutyrate at 160° C. to one side of a sheet and subsequently maintaining the temperature at 160° C. or above for approximately 2 minutes to achieve uniform distribution of the transparentizing agent.

It may be noted that the index of refraction of this sucrose acetate isobutyrate is close to that of cellulose (1.45 vs 1.55 for cellulose) which makes it a very efficient transparentizing agent.

It is believed that the above desirable characteristics of sucrose acetate isobutyrate may be explained on the basis of its molecular structure. The hydrophobic character of the compound may be attributed to the absence of any hydroxyl groups on the completely esterified molecule. On the other hand it is suggested that the strongly negative carboxyl groups on the sucrose ester molecule interact with the polar cellulose unit thus contributing to the rapid attainment of uniform distribution within the sheet and to firm bonding with the cellulose fibers.

The object of the invention, generally stated, is the provision of high quality, transparentized papers which are at least substantially free of residual solvents and compatible with the organic photoreceptors used on drums in xerographic machines, and improved methods of economically producing the same.

This object of the invention can be achieved by impregnating a paper web, preferably 100% cotton rag, with a solution of sucrose acetate isobutyrate in a lower alcohol containing up to 5 carbon atoms, preferably isopropanol. After impregnation, practically all of the solvent is removed from the paper so that it retains no appreciable content of the solvent and preferably retains from about 10% to about 50% by weight of sucrose acetate isobutyrate based on the paper content.

For a more complete understanding of the nature and scope of the invention, reference may now be had to the following detailed description in which preferred working examples are set forth by way of illustration.

EXAMPLE 1

A roll of 100% rag 16# (17×22–500) calendared paper as obtained from the paper mill was transparentized by contacting the web with a roller rotating in a tray of the transparentizing solution. The transparentizing solution consisted of 3 parts sucrose acetate isobutyrate (Eastman Chemical Co.) and 10 parts isopropanol (W/V). The web was travelling at a speed of 35 yards per minute. Excess solution was removed with an air knife and after travelling approximately 10 yards the web was subjected in a dryer to impinging air at 180° C. The air knife pressure was 2.5 inches of water. Upon exiting the dryer the paper was not tacky and had a uniform appearance. The opacity was 48%. The basis weight was 18#. The paper met the requirements of Federal Specification UU-P-561H for tracing paper with respect to opacity, oil leakage, blocking, drafting qualities and UV exposure. There was no detectable odor after heating a sample of the transparentized paper in a closed container at 160° C. The transparentized paper had no adverse effect on the drum of a Xerox 508Q copy machine when prints were made in the normal manner.

EXAMPLE 2

When Example 1 is repeated using air at 170° C. instead of at 180° C., comparable transparentized paper is obtained.

EXAMPLE 3

Example 1 was repeated with identical conditions except that the air knife pressure was reduced to 1.5 inches of water. Upon exiting the dryer the paper was slightly tacky but had a uniform appearance. The paper was sheeted after approximately 24 hours in the pack and found to have no trace of tackiness. The basis weight was 19.5# and the opacity was 40%. In other respects the results were similar to those of Example 1.

EXAMPLE 4

A roll of 100% rag paper with substance weight of 14.4# was transparentized by applying the transparentizing solution in the manner described in Example 1. The transparentizing solution consisted of 3 parts of sucrose acetate isobutyrate and 12 parts isopropanol. The web was travelling at 35 yards per minute. The excess solution was removed by drawing the web over a #20 wire wound rod (R&D Specialties Co.). The paper was then subjected to low velocity room temperature air for approximately 25 seconds, followed by air at 140° C. for approximately 25 seconds followed by air at 170° C. for approximately 30 seconds. After drying the basis weight was 16.4# and the opacity was 45%. In other respects the results were similar to those in Example 1.

EXAMPLE 5

A roll of 100% rag paper with substance weight of 14.4# was transparentized in the manner described in Example 4 except that the transparentizing solution consisted of 9 parts of sucrose acetate isobutyrate and 11 parts isopropanol and the wire-wound rod was #16 instead of #20. After drying the basis weight was 17# and the opacity was 40%. In other respects the results were similar to those in Example 1.

EXAMPLE 6

A 4" wide roll of 100% rag paper was contacted on one side of the web with sucrose acetate isobutyrate 165° C. (viscosity approximately 15 centipoise). After a dwell time of approximately 2 seconds, the paper web was drawn over a scraper to remove all transparentizing agent remaining on the surface. The paper was then held at 170° C. for 2 minutes. Distribution of the transparentizing agent was reasonably uniform and the opacity was approximately 38%.

It will be understood that those skilled in the art will be able to make changes in the foregoing examples without departing from the invention as disclosed and claimed.

What is claimed is:

1. The method of making transparentized paper which is compatible with the organic photoreceptors used on drums in xerographic machines which comprises applying a solution consisting essentially of sucrose acetate isobutyrate in a lower alcohol to a paper web and removing substantially all of the solvent so that the web is substantially free of residual solvent.

2. The method of claim 1 wherein said lower alcohol solvent is isopropanol.

3. The method of claim 1 wherein the amount of sucrose acetate isobutyrate introduced into the paper web is from about 10% to about 50% by weight of the paper prior to treatment.

4. The method of claim 2 wherein the amount of sucrose acetate isobutyrate introduced into the paper web is from about 10% to about 50% by weight of the paper prior to treatment.

5. The method of producing a roll of transparentized paper which is compatible with the organic photoreceptors used on drums in xerographic machines in one pass of a travelling web between a supply roll and a finished roll which comprises, applying a solution consisting essentially of sucrose acetate isobutyrate dissolved in a lower alcohol to said travelling web, removing excess of said solution from said travelling web, drying the travelling web to remove substantially all residual solvent therefrom, and rewinding the treated paper web.

6. The method of claim 5 wherein the amount of sucrose acetate isobutyrate introduced into the paper web is from about 10% to about 50% by weight of the paper prior to treatment.

7. Transparentized paper which is compatible with the photoreceptors used on drums in xerographic machines impregnated with a solution of sucrose acetate isobutyrate in a lower alcohol with no appreciable residual content of said lower alcohol remaining in the transparentized paper.

8. Transparentized paper which is compatible with the photoreceptors used on drums in xerographic machines impregnated with a solution of sucrose acetate isobutyrate in a lower alcohol with no appreciable residual content of said lower alcohol remaining in the transparentized paper and with the residual content of the sucrose acetate isobutyrate being from about 10% to about 50% by weight of the paper content.

* * * * *